US008286271B2

(12) United States Patent
Chiang

(10) Patent No.: US 8,286,271 B2
(45) Date of Patent: Oct. 16, 2012

(54) SWIMMING GOGGLES

(76) Inventor: Herman Chiang, Chung-Ho (TW)

( * ) Notice: Subject to any disclaimer, the term of this patent is extended or adjusted under 35 U.S.C. 154(b) by 392 days.

(21) Appl. No.: 12/700,870

(22) Filed: Feb. 5, 2010

(65) Prior Publication Data

US 2011/0191948 A1 Aug. 11, 2011

(51) Int. Cl.
*A61F 9/02* (2006.01)

(52) U.S. Cl. ..... 2/448

(58) Field of Classification Search ..... 2/426, 439, 2/440, 434, 442, 445, 446, 448, 452; 24/170, 24/173, 178, 191, 265 BC; 351/43
See application file for complete search history.

(56) References Cited

U.S. PATENT DOCUMENTS 7,810,175 B2 * 10/2010 Chiang ..... 2/448
8,042,199 B2 * 10/2011 Chiang ..... 2/448
8,132,271 B2 * 3/2012 Chiang ..... 2/444
2011/0047683 A1 * 3/2011 Chiang ..... 2/446
2011/0219523 A1 * 9/2011 Chiang ..... 2/434
* cited by examiner

*Primary Examiner* — Katherine Moran
(74) *Attorney, Agent, or Firm* — Cheng-Ju Chiang

(57) ABSTRACT

Swimming goggles include a frame body, lenses received in the frame body, and buckles assembled on left and right sides of the frame body. Each buckle has a first cover and a second cover assembled together, and a manipulation element assembled between the first cover and the second cover. The manipulation element has a base bar, a pressing plate formed on an end of the base bar, and two control arms integrally formed on an opposite end of the base bar. Flexible branches respectively extend from the two control arms, and further connect with the base bar. When the free ends of the two control arms are pressed, the branches are pressed and deformed, the base bar being forced to move the pressing plate to a side with an end of the pressing plate as a fulcrum, whereby the pressing plate disengages from the groove of the head strap.

13 Claims, 8 Drawing Sheets

SWIMMING GOGGLES

BACKGROUND OF THE INVENTION

1. Field of the Invention

The present invention relates to swimming goggles, and particularly to swimming goggles which have an easily-adjustable head strap and are worn comfortably.

2. Related Art

Swimming goggles, generally, have buckles for accommodating and adjusting a head strap thereof In prior art, buckles are respectively disposed on a left side and a right side of frames, and are assembled on two ends of a head strap for adjusting length. Each of the buckles comprises a biasing arm for abutting against the head strap. The biasing arm abuts against a serrated groove of the head strap in such a way that the head strap can be tightened merely in a single direction when the biasing arm does not abut the head strap (namely the head strap can be shortened only). The biasing arm has to be released for purpose of loosening the head strap. Thus, it is directly associated with adjustment of the head strap whether the biasing arm abuts against the head strap.

The prior art buckle, which controls abutment of the biasing arm, is commonly designed in compliance with a first lever principle to exert force on an end of a biasing arm, while the opposite end of the biasing arm acts in a reverse direction for releasing the biasing arm. At the same time, a resilient element acts on the end exerted force thereon for returning the biasing arm. In this way, whatever kind of assembly the resilient element has, two components are necessary to contact indirectly for manipulation. This makes manufacture and assembly more difficult, and increases cost. It is a desired issue how to improve the prior art buckles of the swimming goggles to meet the requirements of convenient use and simplified manufacture.

SUMMARY OF THE INVENTION

Accordingly, an object of the present invention is to provide swimming goggles which have simplified structure and assembly, and which have buckles with manipulation elements for controlling abutment to the head strap, whereby length of the head strap can be adjusted simply and accurately.

The swimming goggles comprise a frame body, lenses received in the frame body, and buckles assembled on left and right side of the frame body. Each buckle comprises a first cover and a second cover assembled together for accommodating a head strap, and a base bar assembled between the first cover and the second cover. A biasing pressing plate is formed on an end of the base bar, and two control arms are integrally formed on an opposite end of the base bar. The two control arms extend in an oblique outwardly fashion from the base bar symmetrically, and respectively have free ends formed at opposite sides of the base bar. Flexible branches respectively extend from the free ends of the two control arms, and further connect with the end of the base bar having the pressing plate. Wherein when the two control arms of the buckle are pressed by the free ends of the two control arms, the flexible branches are pressed and deformed, the base bar being forced to move the pressing plate to a side with an end of the pressing plate as a fulcrum, whereby the pressing plate disengages from the groove of the head strap.

The branches have thickness decreasing toward the base bar, thereby producing appropriate return force when deformed.

A stop wall is formed on the first/second cover and faces the base bar when assembled. Thus the two control arms are limited properly in the course of pressing.

A positioning slot is defined in the base bar and nearby the two control arms. An axis post is formed on the first/second cover for corresponding to the positioning slot. The axis post forms a channel therein for providing appropriate flexibility, thereby assembling to the positioning slot firmly in assembly

DESCRIPTION OF THE PREFERRED EMBODIMENTS

Figure 1:
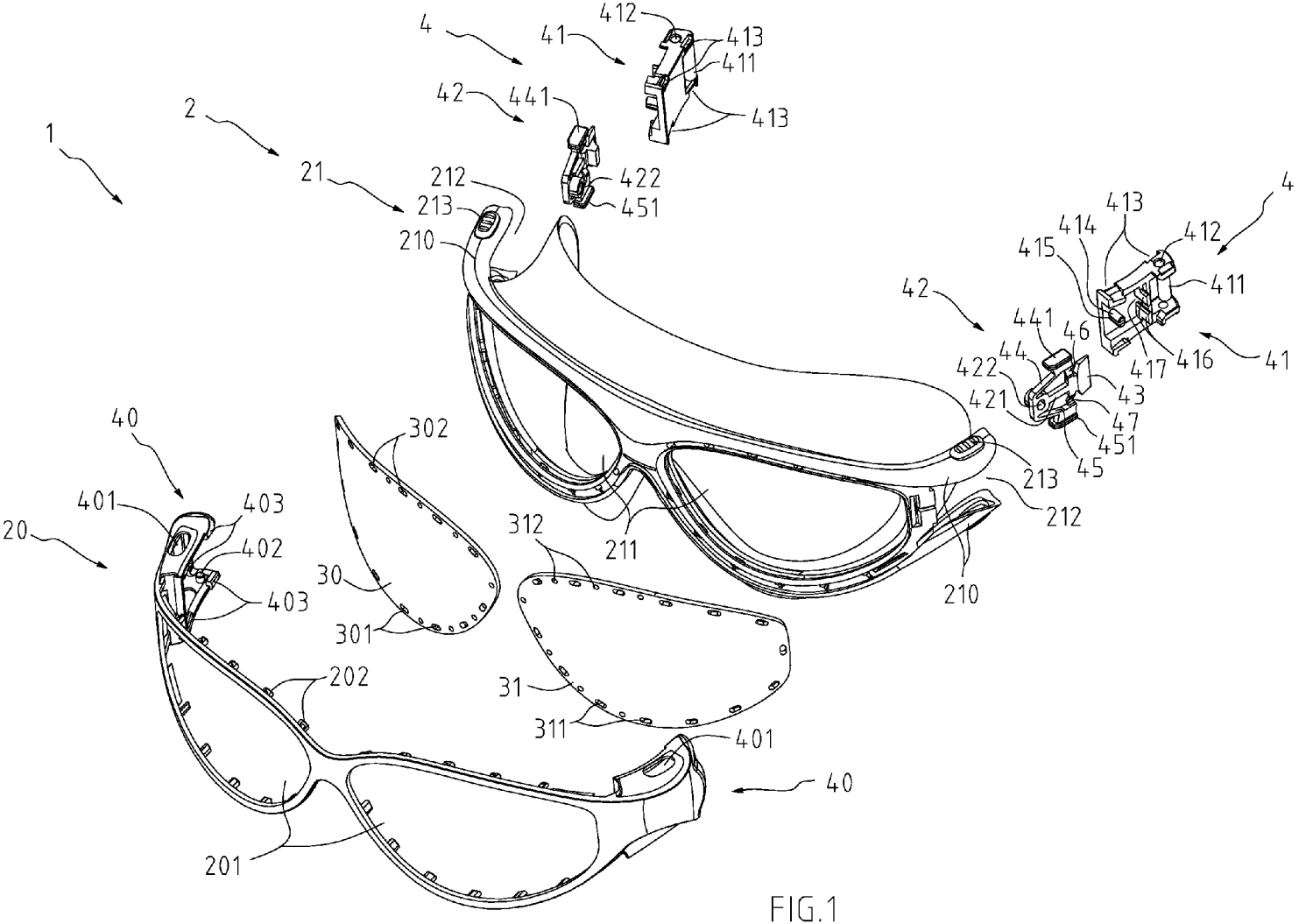
FIGS. 1 and 2 are exploded view of swimming goggles of the present invention from different aspects.
Figure 2:
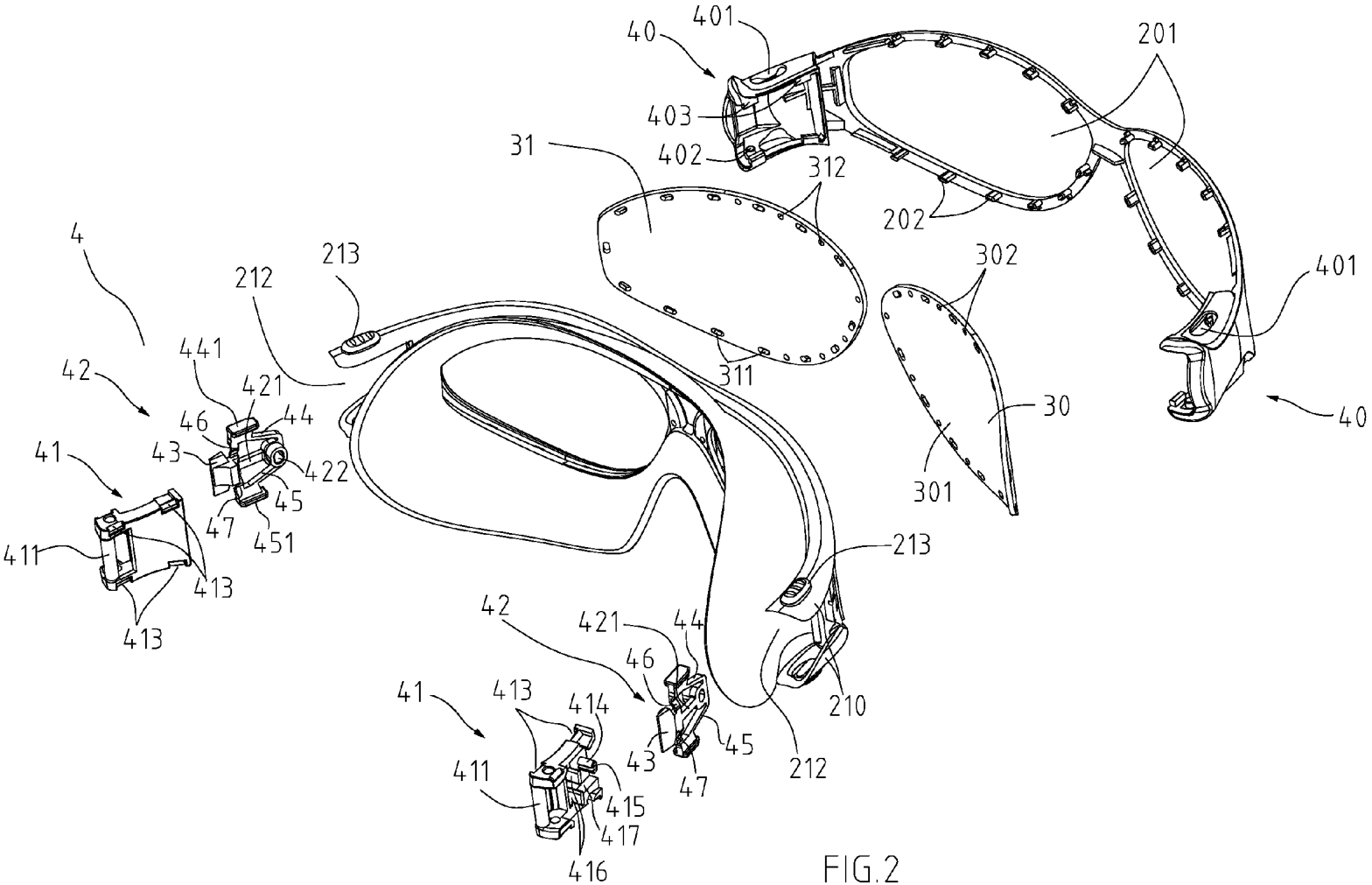

With reference to FIGS. 1 and 2, swimming goggles 1 of the present invention comprise a frame body 2, lenses 30, 31, and buckles 4 assembled on left and right side of the frame body 2. The frame body 2 includes a first assembling frame 20 and a second assembling frame 21, which are made of different materials and are integrally formed. The first assembling frame 20 is made of rigid material, for example Polypropylene (PP). The second assembling frame 21 is made of soft material, for example Thermal Plastic Rubber (TPR). The first assembling frame 20 is enwrapped integrally by injection shaping technique for touching a user's face comfortably. The first assembling frame 20 and the second assembling frame 21 respectively define passageways 201, 211 for receiving lenses 30, 31 therein. Extension lengths 210 are formed on left and right sides of the second assembling frame 21. An opening 212 is defined between extension lengths 210 on each of the left and right sides of the second assembling frame 21 for facilitating assembly of the buckles 4. Pressing portions 213 respectively project from the extension lengths 210 of the second assembling frame 21 for facilitating manipulation of a user's fingers.

A plurality of positioning holes 301, 311 is respectively defined in peripherals of the lenses 30, 31. Protrusions 202 are defined in an inner peripheral of the first assembling frame 20 for corresponding to the positioning holes 301, 311. In this way the lenses 30, 31 are preliminarily positioned in the passageways 201 of the first assembling frame 20. When the second assembling frame 21 is formed by injection shaping technique, the first assembling frame 20 and lenses 30, 31 are enwrapped in the passageways 211 of the second assembling frame 21. A plurality of injection apertures 302, 312 is defined in peripherals of the lenses 30, 31 for holding plastic when integrally shaping.

Figure 8:
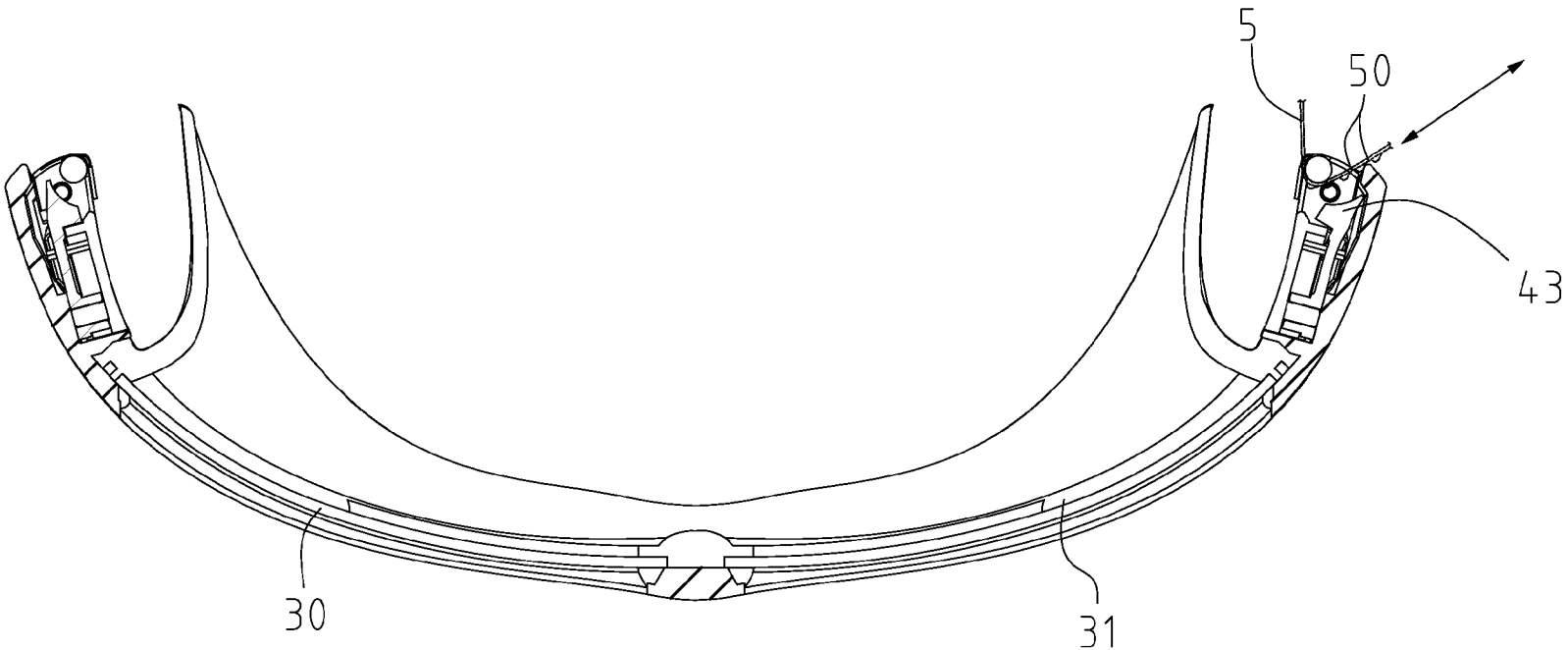

Each buckle 4 comprises a first cover 40 and a second cover 41 assembled together for accommodating a head strap 5 (shown in FIG. 8), and a manipulation element 42 assembled between the first cover 40 and the second cover 41. The first covers 40 are integrally formed on left and right sides of the first assembling frame 20. Each first cover 40 defines a through hole 401 therein. Each second cover 41 forms a shaft stem 411 for positioning the head strap 5. Latch posts 402 are formed inside the first cover 40 for assembling the first cover 40 and the second cover 41 together. A plurality of latch blocks 403 is formed on an outer peripheral of the first cover 40. The second cover 41 defines latch grooves 412 for corresponding to the latch posts 402, and embedding grooves 413 for corresponding to the latch blocks 403, thereby assembling the first cover 40 and the second cover 41 together with retention.

The manipulation element 42 comprises a base bar 421, a biasing pressing plate 43 on an end of the base bar 421, and two control arms 44, 45 are integrally formed on an opposite end of the base bar 421. The base bar 421 as a center, the two control arms 44, 45 extend in an oblique outwardly fashion, and respectively have free ends 441, 451 at sides of the first cover 40 and the second cover 41. The free ends 441, 451 exposed from the through holes have an area larger than that of the pressing portions 213, and have configurations fitting to the pressing portions 213. A positioning slot 422 is defined in the base bar 421 and nearby the two control arms 44, 45. An axis post 414 is formed on the second cover 41 for corresponding to the positioning slot 422. The axis post 414 forms a channel therein for providing appropriate flexibility, thereby assembling to the positioning slot 422 firmly in assembly (see FIG. 3A).

Further referring to FIGS. 1 and 2, flexible branches 46, 47 respectively extend from the free ends 441, 451 of the two control arms 44, 45, and connect with the base bar 421 slantwise. Note that, the base bar 421, the two control arms 44, 45 and the two branches 46, 47 are all made of flexible nylon material. Moreover, the branches 46, 47 have thickness decreasing toward the base bar 421, thereby producing appropriate return force when are pressed and deformed. The free ends 441, 451 of the two control arms 44, 45 extend into the through holes 401 of the first cover 40 and are exposed appropriately. Further referring to FIG. 3A, a stop wall 416 is formed on the second cover 41, and faces the base bar 421 when assembled. A slit 417 is defined in the stop wall 416 for supporting the base bar 421, whereby the two branches control arms 44, 45 are limited properly in the course of pressing.

Figure 3A:
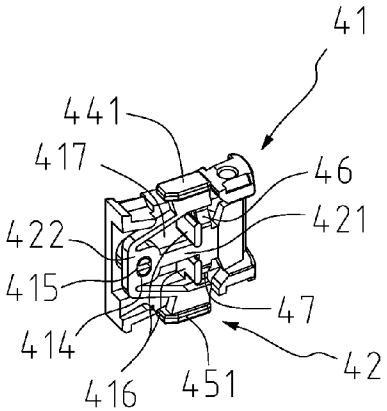
FIGS. 3A and 3B are perspective view of buckles of the swimming goggles, wherein in FIG. 3B, the buckles are assembled on a first assembling frame of the swimming goggles.
Figure 3B:
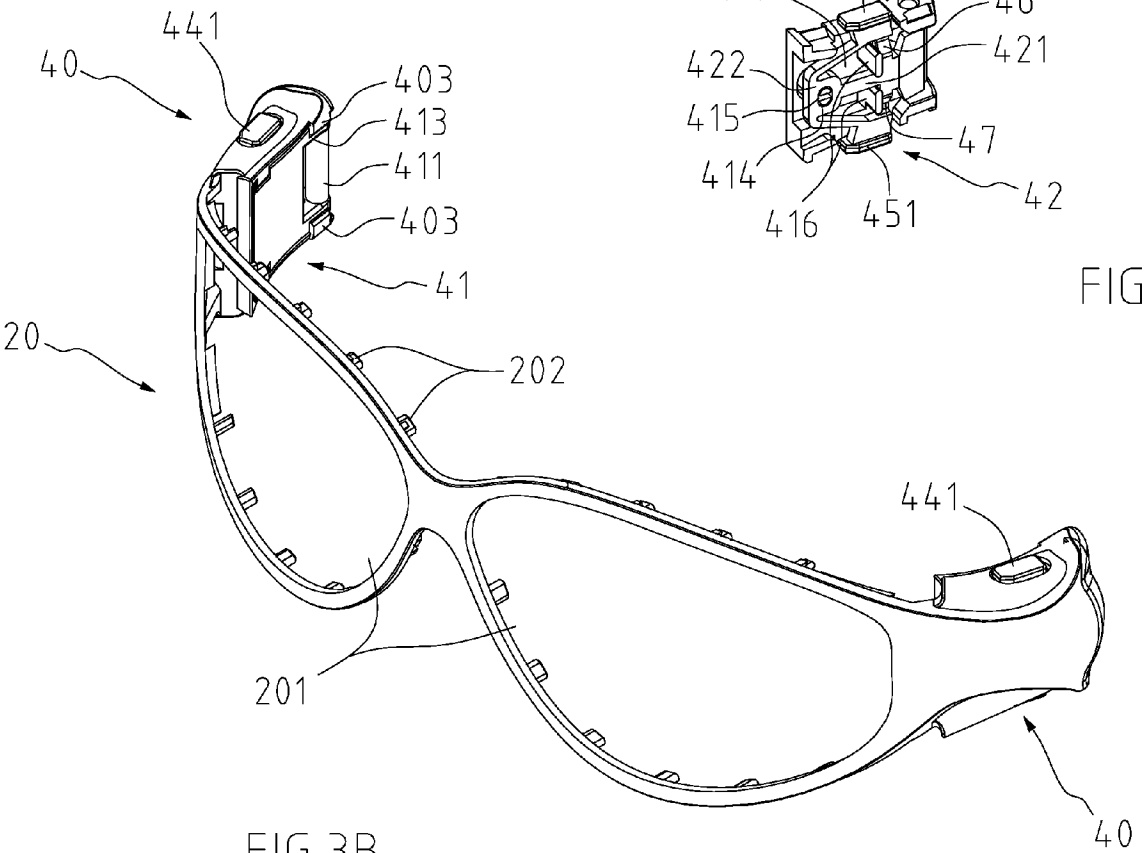
Figure 4:
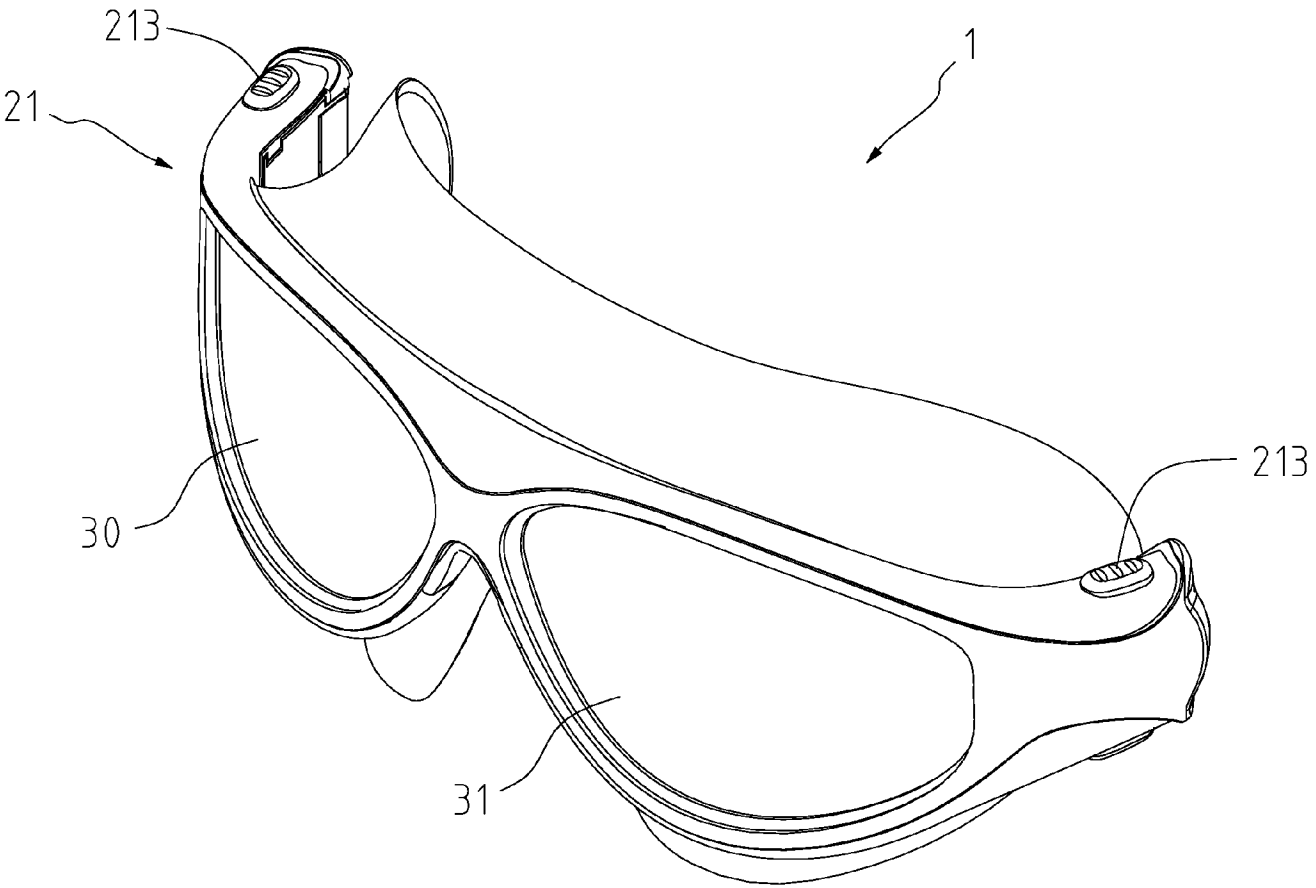
FIG. 4 is a perspective view of the swimming goggles of FIG. 1.

Combining FIGS. 1, 3A-3B and 4, in assembly, the manipulation elements 42 are mounted on the axis posts 414 of the second covers 41, straddling across the slits 417 of the stop walls 416 (see FIG. 3A). The embedding grooves 413 assemble the manipulation elements 42 onto the latch blocks 403 of the first covers 40 (see FIG. 3B). The positioning holes 301, 311 are assembled with the protrusions 202 of the first assembling frame 20 for preliminarily positioning the lenses 30, 31. Then the second assembling frame 21 encompasses the first assembling frame 20 and the lenses 30, 31 by injection shaping technique. Thus, assembly is finished, as shown in FIG. 4.

Figure 5:
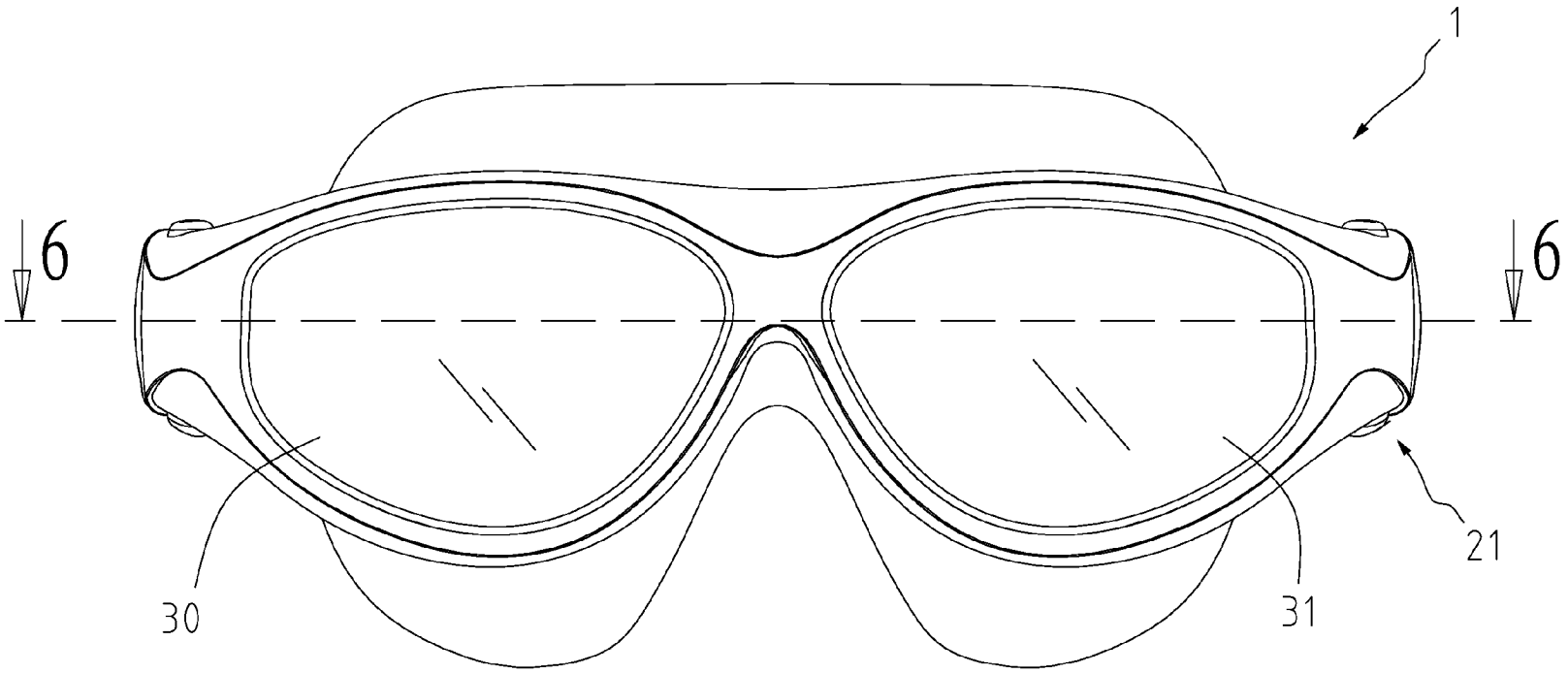
FIG. 5 is a front view of the swimming goggles of FIG. 4.
Figure 6:
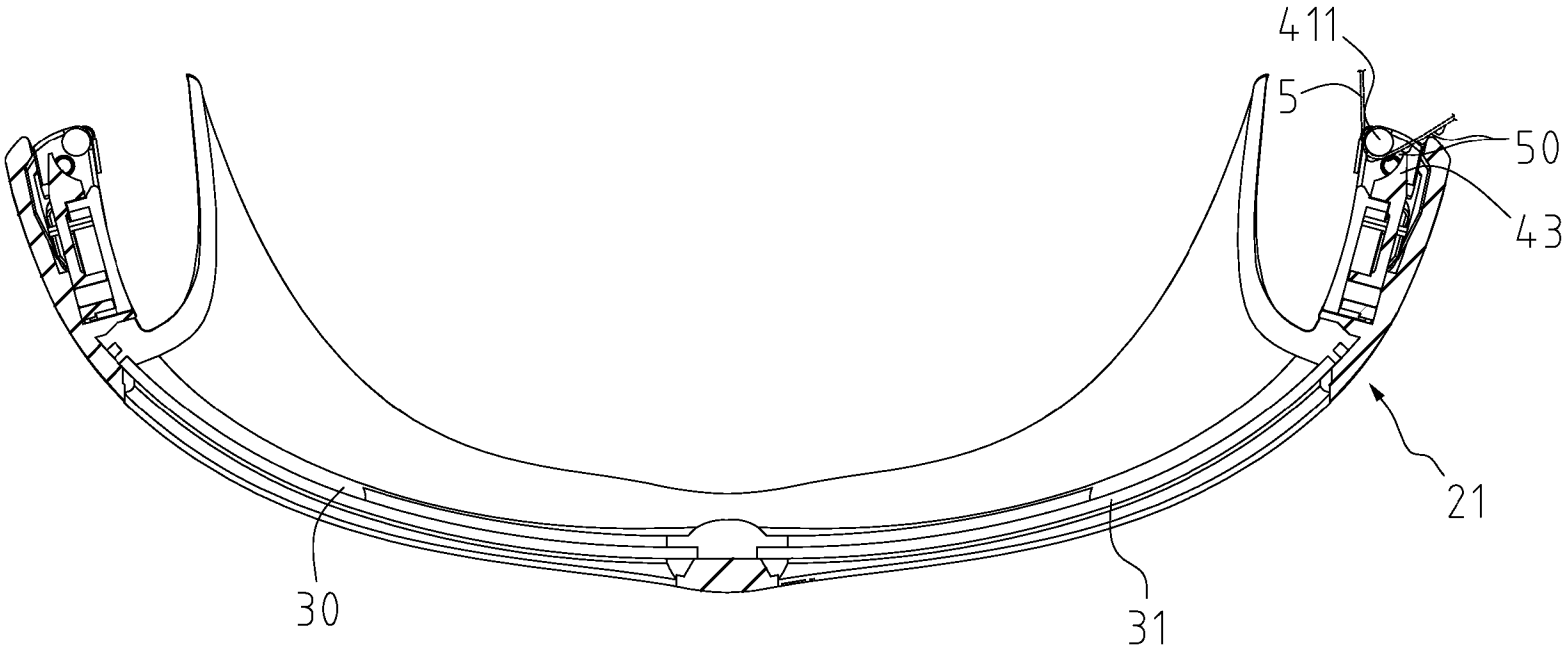
FIG. 6 is a cross-sectional view taken along the line 6-6 in FIG. 5.
Figure 9:
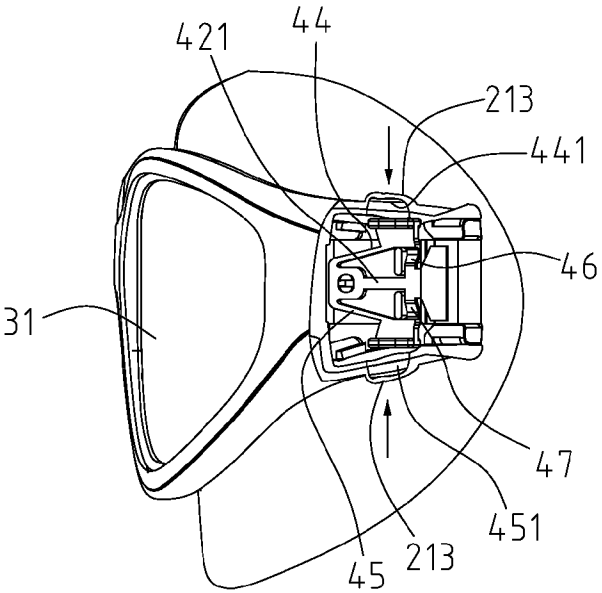
FIGS. 8 and 9 respectively illustrate the buckles of the swimming goggles in FIGS. 6 and 7 being pressed.
Figure 7:
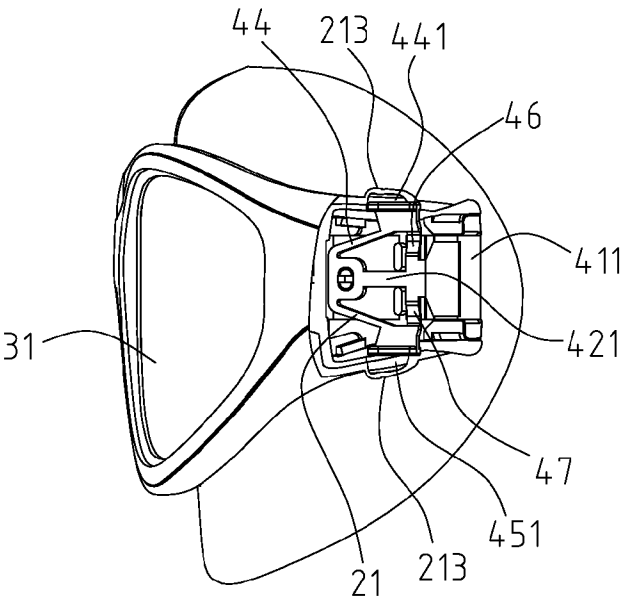
FIG. 7 is a right side view of the swimming goggles, wherein a first assembling frame is sectioned.

With reference to FIGS. 5 through 7, the swimming goggles according to the present invention, the pressing plate 43 abuts against a serrated groove 50 of the head strap 5 so that it is only permitted to tighten in a single direction. Length of the head strap 5 is allowed to be pulled outwardly (as the arrow in FIG. 6) and be shortened only. In order to adjust the length of the head strap 5, a user's thumb and forefinger press the pressing portions 213 downwardly, and correspondingly free ends 441, 451 of the two control arms 44, 45 are pressed, referring to FIGS. 8 and 9. Meanwhile the two control arms 44, 45 are driven to move downwardly, pressing against and deforming the branches 46, 47. The base bar 421 is forced to move the pressing plate 43 to a side with an end of the pressing plate 43 as a fulcrum. The pressing plate 43 disengages from the serrated groove 50 of the head strap 5 for allowing adjustment to the length of the head strap 5. When the pressing portions 213 are released, the branches 46, 47 provide return force arising from deformation, and thus the two control arms 44, 45 return to original positions.

It is understood that the invention may be embodied in other forms without departing from the spirit thereof. Thus, the present examples and embodiments are to be considered in all respects as illustrative and not restrictive, and the invention is not to be limited to the details given herein.

I claim:

1. Swimming goggles, having a head strap defining grooves therein, comprising:

a frame body;

lenses received in the frame body; and buckles assembled on left and right sides of the frame body, each buckle comprising:

a first cover and a second cover assembled together for accommodating a head strap; and a base bar assembled between the first cover and the second cover, a pressing plate being formed on an end of the base bar and used for abutting against one of the grooves of the head strap, and two control arms being integrally formed on an opposite end of the base bar, the two control arms extending in an oblique outwardly fashion from the base bar symmetrically, and respectively having free ends formed at opposite sides of the base bar, flexible branches respectively extending from the free ends of the two control arms, and further connecting with the end of the base bar having the pressing plate;

wherein when the two control arms of the buckle are pressed by the free ends of the two control arms, the flexible branches are pressed and deformed, the base bar being forced to move the pressing plate to a side with an end of the pressing plate as a fulcrum, whereby the pressing plate disengages from the groove of the head strap.

2. The swimming goggles as claimed in claim 1, wherein the base bar, the two control arms and the two branches are made of flexible nylon material, and wherein the branches have thickness decreasing toward the base bar, thereby producing appropriate return force when deformed.

3. The swimming goggles as claimed in claim 1, wherein a stop wall is formed on one of the first cover and the second cover to face the base bar, a slit being defined in the stop wall for supporting the base bar, whereby the two control arms are limited properly in the course of pressing.

4. The swimming goggles as claimed in claim 1, wherein a positioning slot is defined in the base bar and nearby the two control arms, and wherein an axis post is formed on one of the first cover and the second cover for corresponding to the positioning slot, the axis post forming a channel therein for providing appropriate flexibility, thereby assembling to the positioning slot firmly in assembly.

5. The swimming goggles as claimed in claim 1, wherein the frame body includes a first assembling frame and a second assembling frame, which are made of different materials and are integrally formed, and wherein the first assembling frame is made of rigid material, while the second assembling frame is made of soft material, the first assembling frame being enwrapped integrally by injection shaping technique, the first assembling frame and the second assembling frame respectively defining passageways for receiving lenses therein.

6. The swimming goggles as claimed in claim 5, wherein the first cover of the each buckle is integrally formed on one of left and right sides of the first assembling frame, and the second cover of the each buckle forms a shaft stem, thereby accommodating and positioning the head strap.

7. The swimming goggles as claimed in claim 6, wherein extension lengths are formed on left and right sides of the second assembling frame, an opening being defined between extension lengths on each of the left and right sides of the second assembling frame for facilitating assembly of the buckles.

8. The swimming goggles as claimed in claim 7, wherein each first cover defines a through hole for corresponding to the free ends of the two control arms, thereby exposing the free ends appropriately, and wherein pressing portions respectively project from the extension lengths of the second assembling frame for facilitating manipulation of a user's fingers.

9. The swimming goggles as claimed in claim 8, wherein the free ends exposed from the through holes have an area larger than that of the pressing portions, and have configurations fitting to the pressing portions.

10. The swimming goggles as claimed in claim 5, wherein a plurality of positioning holes is respectively defined in peripherals of the lenses, and wherein protrusions are defined in an inner peripheral of the first assembling frame for corresponding to the positioning holes, whereby the lenses are preliminarily positioned on the first assembling frame.

11. The swimming goggles as claimed in claim 10, wherein a plurality of injection apertures is defined in peripherals of the lenses.

12. The swimming goggles as claimed in claim 5, wherein latch posts are formed inside the first cover, and a plurality of latch blocks is formed on an outer peripheral of the first cover, and wherein the second cover defines latch grooves for corresponding to the latch posts, and embedding grooves for corresponding to the latch blocks, whereby the first cover and the second cover are assembled together with retention.

13. The swimming goggles as claimed in claim 5, wherein rigid material of the first assembling frame is Polypropylene (PP), and wherein soft material of the second assembling frame is Thermal Plastic Rubber (TPR).

* * * * *